United States Patent [19]

Estes

[11] 4,331,431

[45] May 25, 1982

[54] TRANSOM SAVER

[76] Inventor: Ronald L. Estes, Red Eagle Rte., Box 124A, Pawhuska, Okla. 74056

[21] Appl. No.: 170,882

[22] Filed: Jul. 21, 1980

[51] Int. Cl.[3] ..... B63H 5/12

[52] U.S. Cl. ..... 440/53; 280/414.1; 248/642; 248/640

[58] Field of Search ..... 280/414 R, 414 A; 248/642, 640, 643, 240.2, 240.3, 240.4; 9/1.2; 440/63

[56] References Cited

U.S. PATENT DOCUMENTS 2,901,267 8/1959 Holselau ..... 248/642
3,693,576 9/1972 Driscoll ..... 248/642
3,941,344 9/1976 Paterson ..... 248/642
4,125,236 11/1978 Landwerlen ..... 248/640

*Primary Examiner*—Trygve M. Blix
*Assistant Examiner*—Harry A. Smith
*Attorney, Agent, or Firm*—James H. Chafin

[57] ABSTRACT

A support arm assembly for boat trailers which is connectable to the drive column of an outboard motor to prevent wear and damage to the boat transom during traveling on the highways or during storage. The support arm assembly comprises a pivotal support arm which is slidably disposed through a bracket member carried by the rear end of the boat trailer whereby the support arm may be retracted under or within the trailer when not in use.

9 Claims, 9 Drawing Figures

TRANSOM SAVER

BACKGROUND OF THE INVENTION

1. Field of the Invention

This invention relates to a support apparatus for the outboard motor of a boat and more particularly, but not by way of limitation, to a stowable, pivotal support arm to be carried by boat trailers for supporting the lower drive column of an outboard motor during storage or transit.

2. History of the Prior Art

Typically, when a boat equipped with an outboard motor is mounted on a trailer for either storage or traveling, the motor is tilted forwardly in order to raise the prop or lower end of the motor to a higher elevation. This provides more clearance for the prop end of the motor for traveling and also provides the necessary clearance for loading the boat onto the trailer or off-loading the boat into the water.

However, when the motor is rotated forwardly, it is supported in a cantilever fashion by the transom of the boat. This constant torque or twisting force on the transom over a period of time weakens and damages the transom.

Even if the motor is well-balanced on the transom, vibration and rough roads will cause the transom to receive undue twisting forces causing fatigue and possible failure of the transom.

There have been various types of makeshift support arms used to prop the motor into its forward position but these arms have to be modified for different types of motors and usually represent either an unwanted protrusion on the trailer when not in use or are removable and soon become lost.

SUMMARY OF THE INVENTION

The present invention provides a transom saver, motor support assembly which is designed for simple and efficient operation and is easily stowable out of the way when not in use.

The device comprises a bracket which may be rigidly secured to the lower end of the trailer. The bracket is provided with a longitudinal rectangular passageway which can be made from a piece of channel or rectangular tubing.

An elongated support arm is slidably disposed in the passageway and is made up of two segments pivotally secured together. The pivot pin arrangements for connecting the two segments must be such that the pivot joint will pass through the passageway when the segments are in longitudinally alignment.

The forward segment has a length just longer than the passageway and is provided with a stop member at the front end to prevent its being pulled rearwardly through the passageway.

The rear segment of the support arm is considerably longer than the front segment and is provided with a cradle bracket at the outer end thereof. The cradle is V-shaped for receiving the lower drive column of substantially any make or model of outboard motor therein. The arms of the V-shaped cradle may be padded to prevent scratching or damaging of the motor column.

A tie-down bracket is also provided at or near the cradle for securing the motor column within the cradle with the use of a rubber strap, Bungi cord or the like.

The support arm segments are made of rectangular tubing material having a cross-sectional shape conforming to the shape of the passageway for slidably fitting therein. The two segments are connected together by a knuckle block member which is rigidly held within one of the segments and pivotally pinned into the other segment. The knuckle is shaped to provide pivoting in only one direction so that the rear support arm segment may be pivoted upwardly at substantially any angle but may not be pivoted downwardly past its alignment with the forward segment.

Hence, when the support arm is not in use, the rear segment is pivoted downwardly into alignment with the forward segment and the entire support arm is pushed forwardly under the boat trailer. There is little need to further secure the support arm since most of its weight is forward of the passageway in the bracket and it is held in place by the cantilever support provided by the bracket.

On the other hand, when the support arm is in use, it is pulled rearwardly until the stop member contacts the forward end of the passageway. The rear segment of the support arm may then be pivoted upwardly to contact the drive column of the outboard motor just below the cavitation plate thereof. The drive column of the motor is then strapped to the end of the cradle of the rear support arm. Hence, the outboard motor is thus being supported by the boat transom and by the cradle of the support arm thereby relieving the twisting forces about the boat transom.

If the boat motor tries to tilt forwardly, the stop member of the support arm contacts the passageway of the bracket preventing such forward movement. On the other hand, if the motor tries to tilt rearwardly or downwardly, the rear support arm segment is at an angle with the forward segment thereby preventing the support arm from moving forwardly through the passageway. Hence, the motor is well supported by the boat transom and the support arm.

DESCRIPTION OF THE DRAWINGS

Other and further advantageous features of the present invention will hereinafter more fully appear in connection with a detailed description of the drawings in which.

DESCRIPTION OF THE PREFERRED EMBODIMENT

Figure 1:
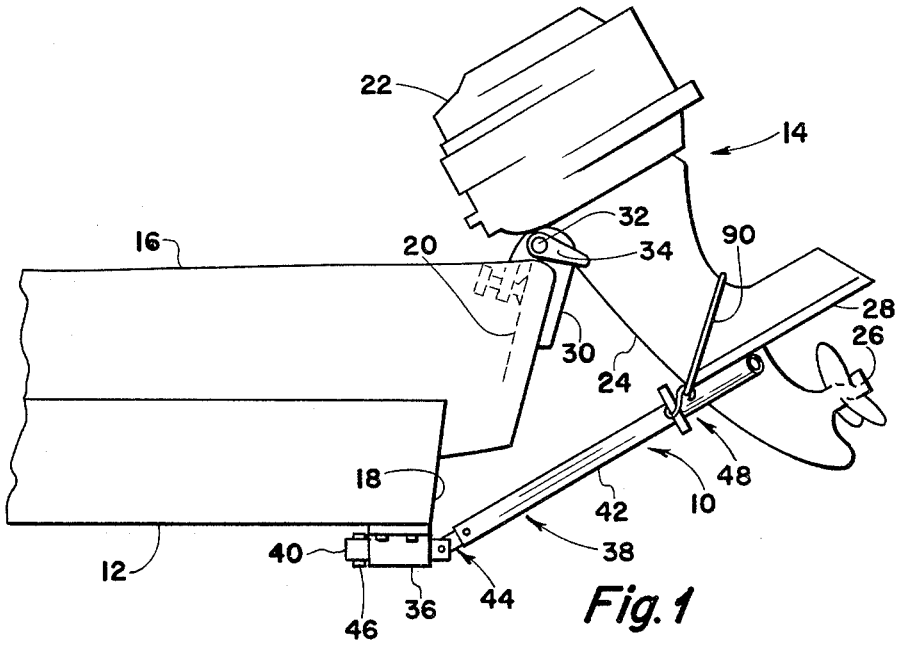
FIG. 1 is a side elevational view of a trailer having a boat and motor mounted thereon, the trailer being equipped with a support arm assembly embodying the present invention.
Figure 5:
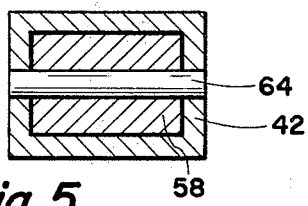
FIG. 5 is an end sectional view of the support arm taken along the broken lines 5—5 of FIG. 3.

Referring to the drawings in detail, reference character 10 generally indicates a transom saver or support arm assembly which is carried by a boat trailer 12 in order to support an outboard motor 14 of a boat 16.

Reference character 18 indicates the rear end of the trailer 12 while the transom of the boat 16 is indicated by reference character 20.

The outboard motor 14 generally comprises a motor housing 22 having a downwardly extending drive column 24 terminating at the lower rear end thereof with a suitable prop or propelling device 26.

Spaced just above the propellor device on most motors is a substantially horizontal cavitation plate 28. The motor 14 is attached to the transom 20 of the boat by means of a suitable clamp 30. The outboard motor 14 is attached to the clamp 30 through a pivot pin 32 having a locking mechanism 34. By use of the locking mechanism 34 and pivot pin 32, the motor may be tilted to substantially any desired orientation and locked into that orientation by means of the locking mechanism 34.

Typically, when the boat 16 is either being placed into the water or taken out of the water, in transit or in storage, the motor is tilted forwardly as shown in FIG. 1 about the pivot pin 32 and locked into position by means of the locking mechanism 34.

However, since the center of gravity of the boat in this position is seldom located directly above the pivot pin 32, and is usually rearward of the pin, a twisting moment is applied via the clamp 30 to the transom 20 as hereinbefore set forth. However, even if the center of gravity was technically located directly over the pivot pin 32, vibration and road irregularities would cause the motor to rock back and forth thereby applying twisting moments to the transom 20.

Since the center of gravity of the motor is typically rearward of the pivot pin 32, the support arm assembly 10 may be utilized to support the drive column 24 of the motor in a manner that will be hereinafter set forth.

The support arm assembly 10 generally comprises a bracket member 36 which is normally rigidly secured to the lower rear end of the trailer 12.

The support arm assembly 10 further comprises an elongated support arm 38 which is made up of a forward segment 40 and a rear segment 42. The segments 40 and 42 are provided with a pivoting member 44 for pivotally connecting the two segments together. The front end of the forward segment 40 is provided with a stop member 46 to prevent retraction in a rearward direction out of the bracket 36 in a manner that will be hereinafter set forth. The rear end of the rear segment 42 is provided with a cradle member 48 for receiving the front portion of the drive column 24 of the motor 14 therein.

Figure 2:
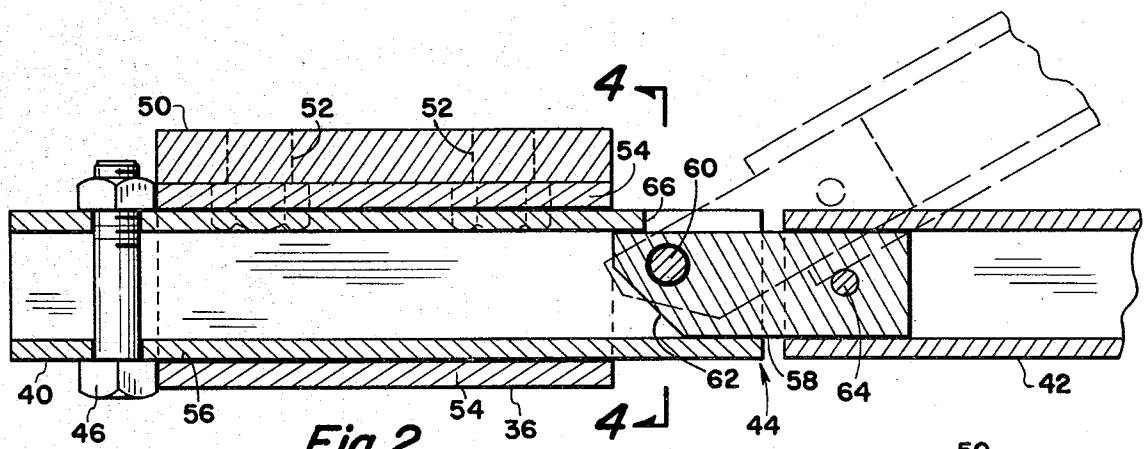
FIG. 2 is a side elevational sectional view of the support arm bracket and pivot pin assembly of the device of FIG. 1.
Figure 4:
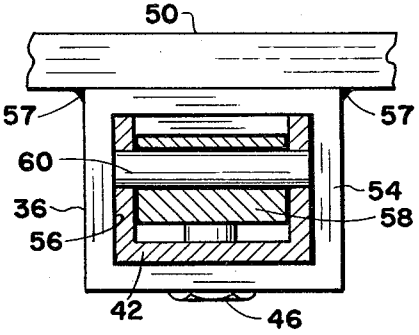
FIG. 4 is an end sectional view of the support arm and bracket taken along the broken lines 4—4 of FIG. 2.
Figure 3:
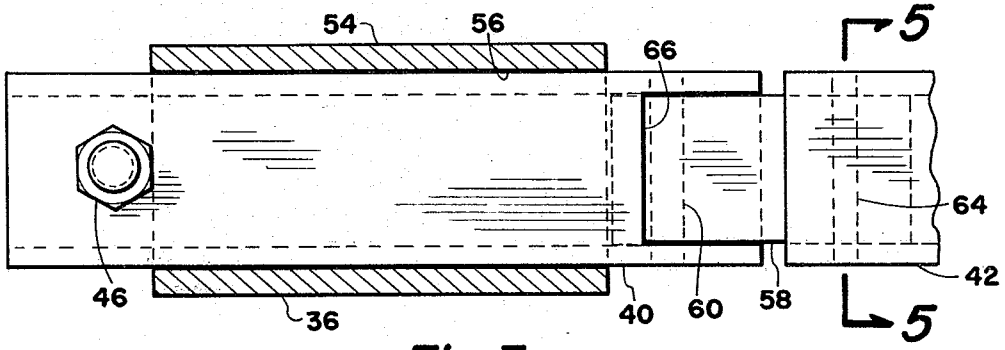
FIG. 3 is a top sectional view of the device of FIG. 2.

Referring to FIGS. 2 through 4, the bracket 36 generally comprises an attachment plate 50 which is rigidly attached to a lower frame member of the trailer 14 and positioned laterally on the trailer 14 to be in longitudinal alignment with the position of the motor on the boat transom. The plate member 50 is rigidly secured to the trailer by a plurality of bolts 52 or may be welded (not shown). The bracket 50 may be made of substantially any shape to conform with the particular trailer frame configuration.

The bracket 36 further comprises an elongated hollow rectangular tube member 54 which forms a longitudinal rectangular passageway 56 therethrough. The tube member 54 is attached to the plate 50 in any well known manner such as by weld joints 57. It is noted that the rectangular passageway 56 may be formed by a piece of channel section (not shown) welded against the bottom surface of the plate member 50.

The forward segment 40 of the support arm 38, as hereinbefore set forth, is provided with a stop member 46 which may be a bolt and nut as shown in FIG. 2. The forward support arm segment 40 has a rectangular shape similar to the passageway 56 for slidably fitting through said passageway 56 but will not rotate with respect thereto. The length of the support arm forward segment is just a little longer than the passageway 56 so that the stop member 46 may be attached to the forward end thereof to prevent removing the segment 40 through the passageway 56.

The rear segment 42 of the support arm 38 comprises an elongated similar piece of rectangular tubing, the outer dimensions being substantially the same as the passageway 56 for slidably passing through said passageway.

The pivot pin assembly 44 for connecting the forward support arm segment 40 to the rear support arm segment 42 comprises a rectangular block member 58 for forming a knuckle joint. The block member 58 is rectangular in cross section and shaped and sized to fit snugly within the support segments 40 and 42 as shown in FIG. 2.

The rear end of the knuckle member 58 is rigidly secured within the front end of the rear support arm segment 42 by means of a pin member 64.

One end of the knuckle member 58 is pivotally attached to the forward support arm segment 40 by means of a horizontally oriented pivot pin 60. The forward lower end of the knuckle member 58 is provided with a bevel 62 which extends rearwardly of the center line axis of the pin member 60 to allow pivoting of the knuckle member 58 and rear support arm 42 in an upward direction as shown by the dashed lines in FIG. 2.

A rectangular recess 66 is provided in the upper surface of the forward support arm segment 40 directly above the pivot pin 60 to allow the knuckle member 58 to pass between the side walls of the forward support arm segment 40 when being pivoted upwardly as shown in the drawings.

It can readily be seen from the shape of the knuckle member, and the bevel 62 thereof along with the position of the upper window 66, the rear support arm segment 42 may be pivoted upwardly out of alignment with the forward segment 40 but cannot be pivoted downwardly. Therefore, when the rear support arm segment 42 is in a raised or tilted-up position, the angle provided at the pivot pin assembly 44 prevents any forward movement of the support arm through the passageway 56.

Figure 6:
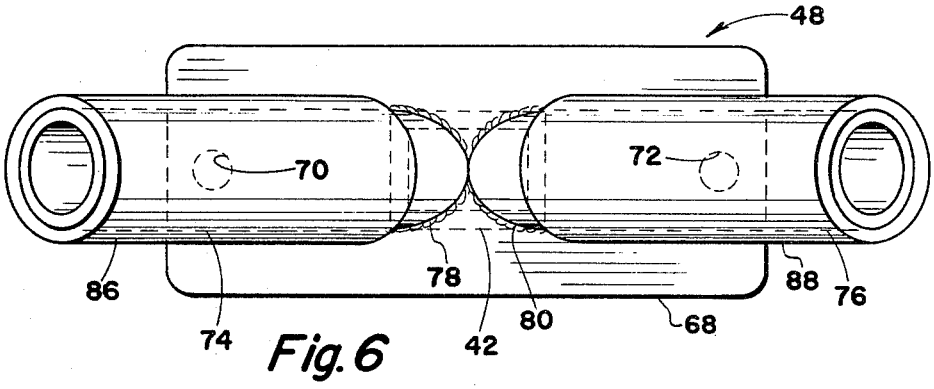
FIG. 6 is an end view of the rear support arm segment of the device of FIG. 1.

Referring now to FIG. 6, the cradle assembly 48 comprises a plate member 68 which is welded directly to the outer end of the rear support arm segment 42. The plate member 68 is provided with a pair of oppositely disposed bores 70 and 72 therein.

Figure 7:
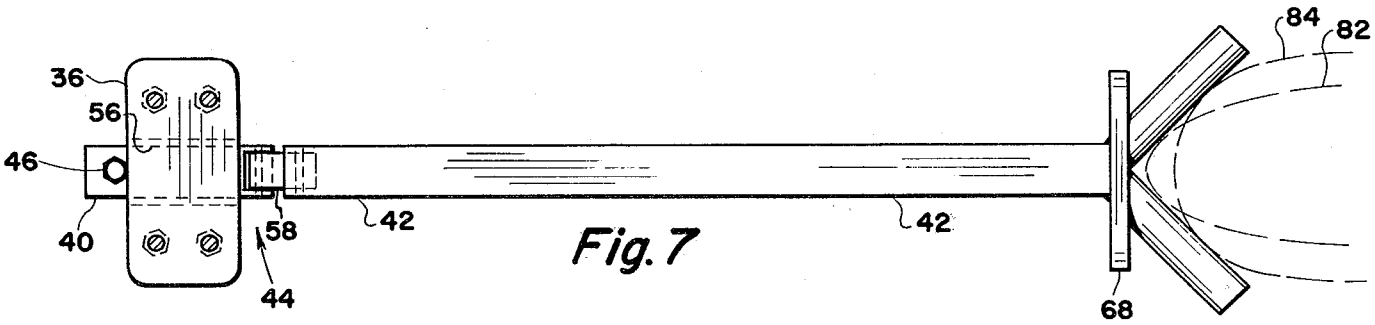
FIG. 7 is a top plan view of the support arm assembly embodying the invention.

The rearward face of the plate member 68 is provided with a pair of outwardly extending tube sections 74 and 76 which are configured in a V-shape as clearly shown in FIG. 7, the forward ends of which are welded to the plate member 68 by weld joints 78 and 80, respectively. Making the tube members 74 and 76 in a V-shape permits the acceptance of a variety of different shaped lower drive housings 24 therein as shown in FIG. 7 by the dashed lines 82 and 84.

A pair of elongated sleeve members 86 and 88 may be fitted on to the tube members 74 and 76, respectively. These sleeve members 86 and 88 may be made of rubber or other pliable material to act as a cushion in supporting the lower drive column member 24 therein. When the drive column 24 is set into place within the cradle 48, a suitable tie down cord, elastic strap or rope 90 may be secured around the drive column 24, the ends of which are attached to the holes 70 and 72 of the plate member 68 in order to tightly secure the drive column to the cradle 48.

Figure 8:
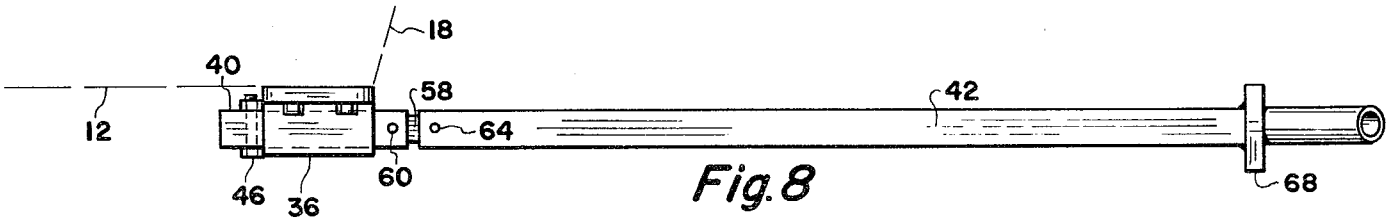
FIG. 8 is a side elevational view of the assembly of FIG. 7.
Figure 9:
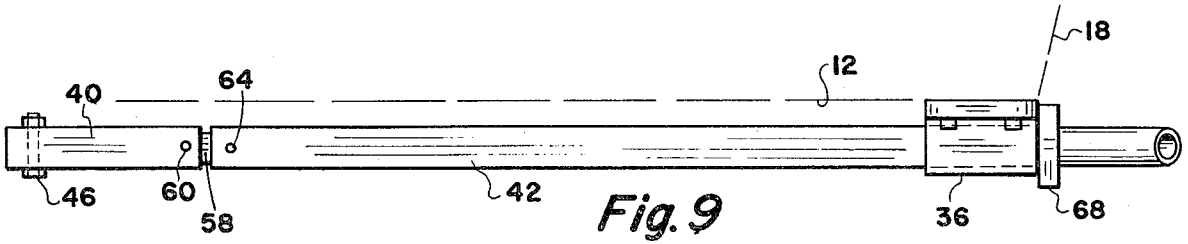
FIG. 9 is a side elevational view of the assembly of FIG. 8 in a stowed position.

Referring now to FIGS. 7, 8 and 9, FIGS. 7 and 8 depict a top plan view and a side elevational view, respectively, of the support apparatus in an extended position rearward of the boat 12. It can be seen that when the forward segment 40 and rear segment 42 of the support arm are in longitudinal alignment as shown in FIGS. 7 and 8, the knuckle member or block 58 does not protrude outside the rectangular cross-sectional shape of the support arm segments and therefore may slidably pass through the passageway 56 of the bracket 36. Hence, when the support arm is not in use, it is lowered to a substantially horizontal position as shown in FIGS. 7 and 8 and then pushed forwardly back under the bottom of the trailer 12 until the plate 68 contacts the bracket as shown in FIG. 9.

It can be seen that when the support arm assembly is in the position as shown in FIG. 9, the center of gravity of the support arm is well forward of the bracket. Therefore, the support arm is supported in a cantilever fashion and will tend to remain in position because of the counter-clockwise moment being produced by the support arm as shown in FIG. 9.

In operation, when it is desired to use the support arm to support a motor, the support arm is pulled rearwardly to a position as shown in FIG. 8 and the rear segment 42 then is tilted upwardly until the cradle 48 receives the lower portion of the drive column 24 therein as shown in FIG. 1. The motor may then be firmly attached to the cradle 48 by means of a stretchable cord 90 that is connected to the attachment plate 68. This normally represents a positive attachment since the cord may pass around the drive column 24 but over the cavitation plate 28 thereby securing the drive column in the cradle.

To remove the support arm from contact with the motor, the tie down member 90 is removed and the rear support arm segment 42 is then pivoted downwardly into alignment with the forward support arm segment 40 as shown in FIG. 8 and then pushed forwardly under the trailer as shown in FIG. 9.

From the foregoing it is apparent that the present invention provides a simple and efficient support arm assembly for use with boat trailers in order to lessen or remove the torque normally applied by the motor to the transom of the boat in order to save wear, tear and fatigue on said transom. It is further seen that the pivotal mounting of the support arm makes the support arm usable with many different types and models of motors so that it becomes practically universal as an outboard motor support.

It can further be seen that this support arm assembly may be easily and quickly stowable under the trailer when not in use. The support arm assembly can also easily be removed for maintenance and repair by simply removing the bolt or stop member 46 and simply pulling the support arm assembly rearwardly free of the bracket 36.

Whereas the present invention has been described in particular relation to the drawings attached hereto, other and further modifications apart from those shown or suggested herein may be made within the spirit and scope of the invention.

What is claimed is:

1. A boat transom saver for use with a boat trailer to support the drive column of an outboard motor which in turn is carried by the transom of a boat, the transom saver comprising:

a bracket attachable to the bottom rear portion of a boat trailer, a longitudinal passageway provided through the bracket;

an elongated support arm slidably disposed within the passageway and comprising a forward support segment longer than the length of the longitudinal passageway of the bracket, a stop member carried by the front end of the forward segment to prevent rearward movement thereof through the passageway and an elongated rear support arm segment comprising a cradle member carried by the back end of the rear segment, a pivot pin assembly for pivotally securing the forward and rear segments together, said pivot pin assembly being capable of being passed through the bracket passageway when the segments are in mutual alignment, whereby the support arm may be pulled rearwardly from a stowed position until the forward segment is inside the passageway whereupon the rear segment may be pivoted upwardly so that the cradle member engages the drive column of the outboard motor.

2. A transom saver as set forth in claim 1 wherein the bracket passageway is rectangular in cross-sectional shape and wherein the support arm has a similar rectangular cross-sectional shape.

3. A transom saver as set forth in claim 1 wherein the pivot means for pivotally securing the forward support arm segment to the rear support arm segment includes means to prevent the rear segment from pivoting downwardly beyond alignment with the forward segment.

4. A transom saver as set forth in claim 1 wherein the bracket passageway is substantially horizontally oriented and the rear support arm segment is longer than the forward segment such that when the support arm is moved to a forward position, it is supported in cantilever fashion by the bracket to prevent accidental rearward movement thereof.

5. A transom saver as set forth in claim 1 wherein the support arm segments are constructed of hollow rectangular material and the pivot pin assembly comprises an elongated rectangular block having one end secured within one segment and the other end pivotally carried within the other segment by a horizontal pivot pin, the end of the block member adjacent the pivot pin being shaped to permit pivoting of the rear segment in an upward direction out of longitudinal alignment with the forward segment.

6. A transom saver as set forth in claim 5 wherein the lower corner of the shaped end of the block is bevelled adjacent the pivot pin to form a knuckle member and the upper portion of the support arm material adjacent the pivot pin is provided with an aperture for receiving the knuckle member therethrough when the rear segment is pivoted upwardly.

7. A transom saver as set forth in claim 1 wherein the cradle member comprises a V-shaped member for receiving the drive column of the outboard motor therein.

8. A transom saver as set forth in claim 7 wherein the V-shaped member comprises a pair of outwardly extending rods and including protective sleeve members of a pliable material for covering the rods to prevent damage to the drive column of the motor.

9. A transom saver as set forth in claim 1 and including a tie-down plate member carried by the back end of the rear support arm segment adjacent the cradle member for tying the drive column of the motor to said cradle member.

* * * * *